US010047584B2

(12) United States Patent
Stowe et al.

(10) Patent No.: US 10,047,584 B2
(45) Date of Patent: Aug. 14, 2018

(54) LOWER MILL SPACED CUTTING RING STRUCTURE

(71) Applicant: Baker Hughes Incorporated, Houston, TX (US)

(72) Inventors: Calvin J. Stowe, Bellaire, TX (US); Tejas J. Ghegadmal, Houston, TX (US); Andrew D. Ponder, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 75 days.

(21) Appl. No.: 15/191,026

(22) Filed: Jun. 23, 2016

(65) Prior Publication Data

US 2016/0298408 A1 Oct. 13, 2016

Related U.S. Application Data

(63) Continuation of application No. 14/096,773, filed on Dec. 4, 2013, now Pat. No. 9,416,612.

(51) Int. Cl.

| | |
|---|---|
| ***E21B 29/06*** | (2006.01) |
| ***E21B 7/06*** | (2006.01) |
| ***E21B 10/26*** | (2006.01) |
| ***E21B 10/42*** | (2006.01) |
| ***E21B 10/46*** | (2006.01) |

(52) U.S. Cl.

CPC ..... *E21B 29/06* (2013.01); *E21B 7/061* (2013.01); *E21B 10/26* (2013.01); *E21B 10/42* (2013.01); *E21B 10/46* (2013.01)

(58) Field of Classification Search

CPC . E21B 7/046; E21B 7/06; E21B 7/061; E21B 7/064; E21B 10/26; E21B 2010/425; E21B 10/42; E21B 10/54; E21B 10/55; E21B 29/06

See application file for complete search history.

(56) References Cited

U.S. PATENT DOCUMENTS

| | | | |
|---|---|---|---|
| 5,474,126 | A | 12/1995 | Lynde et al. |
| 6,109,347 | A | 8/2000 | Ferguson et al. |
| 7,370,702 | B2 | 5/2008 | Stowe |
| 7,575,049 | B2 | 8/2009 | Stowe et al. |
| 2007/0007000 | A1 | 1/2007 | Dewey et al. |
| 2007/0261840 | A1 | 11/2007 | Stowe et al. |
| 2008/0093076 | A1 | 4/2008 | Patil et al. |
| 2008/0185148 | A1 | 8/2008 | Carter et al. |
| 2012/0073880 | A1 | 3/2012 | Lynde |

FOREIGN PATENT DOCUMENTS

| | | | |
|---|---|---|---|
| CA | 2288494 | A1 | 4/2001 |
| WO | 2003083250 | A1 | 10/2003 |

*Primary Examiner* — Cathleen R Hutchins

(74) *Attorney, Agent, or Firm* — Steve Rosenblatt

(57) ABSTRACT

The cutting structure on the lower mill is arrayed in rows that are preferably parallel. The cutting structure in each row is made sharper and more durable than prior designs with the objective of cutting the window higher than where the window mill started the window. The use of the rows increases the contact stress of the inserts on the casing inside wall because at any given time fewer and sharper inserts are cutting the casing wall to lengthen the window. As a row wears down the next row takes over to continue the cutting where the previous row was active and to further penetrate the casing wall. The cutout angle can also increase as this occurs. As a result a decreased insert density results in more effective casing wall cutting to extend the window to allow larger tools to exit into the window off the whipstock.

19 Claims, 5 Drawing Sheets

LOWER MILL SPACED CUTTING RING STRUCTURE

PRIORITY INFORMATION

This application is a continuation of U.S. patent application Ser. No. 14/096,773 filed on Dec. 4, 2013.

FIELD OF THE INVENTION

The field of the invention is window milling and more particularly milling with a window mill and at least a lower mill above for extending and widening the window cut by the window mill using a cutter layout on a lower mill that promotes a higher location of the top of window.

BACKGROUND OF THE INVENTION

A whipstock is a long, hardened steel wedge that forces a window mill to cut out through the side of casing to create a window. The smaller the angle change at the top of the whipstock, the larger the drilling assembly that can span across the angle change at top of whipstock, and so pass through the window. Smaller angles require longer windows and more metal to be cut. Whipstock angle is typically referred to as a measure of dogleg severity, but it is actually degrees of angle change per 100 ft. Since the angle changes abruptly at the top of whipstock, this measure is technically infinite. Instead it is assumed that the angle of the pipe changes over some distance as the pipe bends in a radius rather than at a point. Any design feature that makes the angle change more gradual will allow a longer, larger diameter drilling assembly to pass through. The two casing exit bottom hole assembly (BHA) design goals are maximum life and drilling assembly size.

A typical 3 mill window cutting BHA consists of an upper watermelon mill, a lower watermelon mill and a window mill. The window mill moves to the side as it progresses down the whipstock, which moves the lower toward the casing as well. Bending between the lower and the window mills starts when the BHA has rotated enough for the upper and the lower to contact the casing. These two contact points constrain the lower from further lateral movement (FIG. 7 below). The greater the clearance between the mills and the casing, the farther the window mill moves down the whipstock before the lower contacts the casing. After contact, the pipe between the lower and window mill is bent as the window mill continues to be forced to the side. The length and diameter of lower blades can further increase the bending. As the flex joint between the upper and lower is bent, the lower is inclined in the casing. If the lower diameter is large and the blades are long, the front and back of the blades can contact the opposite sides of the casing and cause the mill to lock up. After lock up, the inclination of the lower is fixed, so bending between the lower and the window mill increases rapidly. The lower should be dimensioned such that it is free to incline to the whipstock angle. The bending between the lower and window mills increases until lower moves onto the scoop, and so is greatest when the lower is at the top of the whipstock. When the lower spans the angle change at the top of the whipstock, it interferes with the casing at the top of the window, so the rotary torque increases at this point. Torque and bending are greatest when the lower is at the top of the whipstock.

If the BHA bending is excessive; the stress below the lower mill blades will be high enough to crack the body from fatigue. It is difficult for the window mill to first mill through the casing, and excessive bending further increases the force required. Before the window mill "gets out" through the casing, a large area of the window mill is bearing on the casing and a high side force is required for it to cut out. The force exerted on the window mill by the bent pipe between the window mill and the lower is in the opposite direction, so the force the whipstock must exert to cut out is increased by the amount required to overcome the bending force.

The most effective variable for controlling bending stress is the lower mill diameter. The smaller the diameter, the greater the clearance between the lower mill and the casing, and the farther down the whipstock the window mill will be before the lower contacts the casing and the lateral window mill movement starts bending the pipe. Reducing the lower diameter allows the designer to choose the point at which bending begins. The further the onset of bending is delayed, the lower the peak bending stress and the fewer of cycles of high bending stress will occur.

The principal function of the lower is to dress the top of the window. The "kink" in the wellbore path is at top of whipstock where the angle changes. In order to produce a low drag window, the lower should start cutting into the casing above the whipstock to provide clearance for long, large diameter drilling BHA elements. The lower needs some load against the casing for cutting, but excessive load wears the cutting structure quickly and can make the mill too smooth to cut effectively. There is a side load "sweet spot" where it is high enough to cut casing, but does not cause excessive torque, mill wear, pipe fatigue, and milling into the whipstock.

After the lower is on the scoop it is aligned with the window mill, and the bending between them is greatly reduced. However, there is now an angle change between the lower and the upper, and the bending of the flex joint is increased. The bending stress above the lower mill is less severe because the pipe between the lower and upper is much longer than between the lower and window mill. This bending pushes the window mill against the whipstock which causes it to stay in contact with the whipstock farther before it drills out into the formation. Note that side force between the window mill and the whipstock is not needed on the top half of the exit to keep the window mill against the whipstock because it is contained by the casing until the window width is equal to the window mill diameter.

Technically, the side force SF, for a bent pipe is given by the equation:

$$SF = \frac{3E\pi(OD^4 - ID^4)d}{8L^3}$$

where:

E is the modulus of elasticity d is the deflection

OD is pipe OD

ID is pipe ID

L is the length of the pipe

The side force increases as the fourth power of the pipe diameter and the third power of the length. So side force increases exponentially as the pipe diameter is increased and the length is shortened. For the same deflection, a 5" diameter pipe has 8 times as much side load as a 3" diameter pipe. A 3 ft pipe has 8 times as much side load as a 6 ft pipe.

If this restoring side force into the whipstock is too large, the bending stress on the lower will be excessive and it will fail in a short period of time. A high force will also increase window mill wear and the depth cut into the whipstock, which lowers the top of the window. Excessive bending force is to be avoided.

In a three mill casing exit BHA, the principal function of the lower mill is to cut additional casing away from the top of the casing exit window. The top of the whipstock is an abrupt angle change that causes long, large diameter drilling assemblies to bear against the top of the window when they span the angle change. The higher the top of the window, the larger the drilling assembly that can mount the whipstock without interference. Conventional lower mills come in two basic styles. The traditional style has a long full diameter section to reduce diametral wear. The objection to this design is a long length of cutting structure bearing on the casing slows the rate the mill cuts into the casing, which reduces the angle of the cut and lowers the top of the window (FIG. 1). The angle of the mill is exaggerated for clarity in the figure. The actual length of cutting structure engaging the casing is longer because the mill is only inclined about 2°. The long angle of engagement tends to wear a long taper on the cutting structure that further increases contact area.

The other mill style reduces contact area by making OD length short. The objection to this design is the after the initial cutters breakdown, there is no cutting structure left to continue cutting.

The present invention comprises a number of short OD surfaces to combine the aggressive cutting of a short OD surface with the longevity of a large number of cutters (FIG. 2). The number of rows bearing on the long angle cut in the casing is reduced by half for faster cutting, but a sufficient number of cutters are provided to complete the cutout and maintain the original mill OD. This will increase the angle of the cut and raise the top of the window. Shallow grooves are cut into the blades underneath the cutters to locate them when they are applied to the mill. As shown in FIG. 3, when the lead cutter breaks away, the following cutter will cut the same path again, but deeper. This also helps increase the cutout angle. The standard mill and the new cutting ring mill are shown in FIGS. 4 and 5. FIG. 4 shows the typical standard mill with Long OD surface and Glyphaloy® cutting structure where minor damage occurs at the leading edge while cutting above the whipstock and at the trailing edge while spanning the top of whipstock. FIG. 5 illustrates the cutting structure of the present invention.

The following references are relevant to some of the aspects of the present invention. CA2288494 (C); US 2008/0093076 A1, U.S. Pat. No. 7,575,049 B2 and U.S. Pat. No. 7,370,702 B2.

Those skilled in the art will understand additional aspects of the invention by a review of the description of the preferred embodiment and the associated drawings while recognizing that the full scope of the invention is to be determined by the appended claims.

SUMMARY OF THE INVENTION

The cutting structure on the lower mill is arrayed in rows that are preferably parallel. The cutting structure in each row is made sharper and more durable than prior designs with the objective of cutting the window higher than where the window mill started the window. The use of the rows increases the contact stress of the inserts on the casing inside wall because at any given time fewer and sharper inserts are cutting the casing wall to lengthen the window. As a row wears down the next row takes over to continue the cutting where the previous row was active and to further penetrate the casing wall. The cutout angle can also increase as this occurs. As a result a decreased insert density results in more effective casing wall cutting to extend the window to allow larger tools to exit into the window off the whipstock.

DETAILED DESCRIPTION OF THE PREFERRED EMBODIMENT

Figure 6:
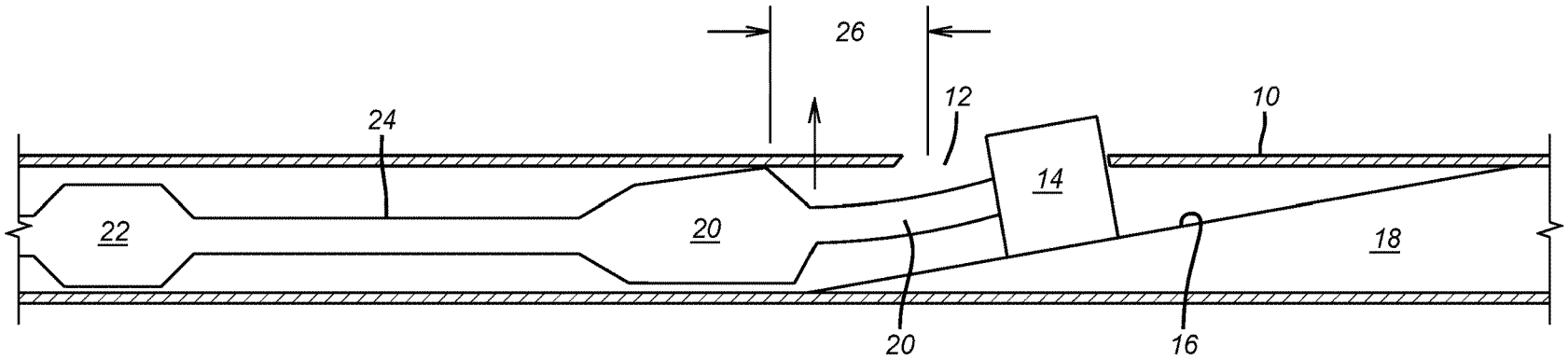
FIG. 6 shows a series of mills making a window in casing.

FIG. 6 illustrates a casing 10 where a window 12 is started with a window mill 14 running on a ramp 16 of a whipstock 18. A connector 20 connects the whipstock 18 to the lower mill 20. The upper mill 22 is connected to the lower mill 20 by connector 24. The present invention is focused on milling away more casing wall in zone 26 to extend the window 12 length so that larger assemblies can make the turn into the lateral beyond the window 12. At the same time the objective is also to enhance the milling time as well as to get a longer running time for the lower mill 20.

Figure 1:
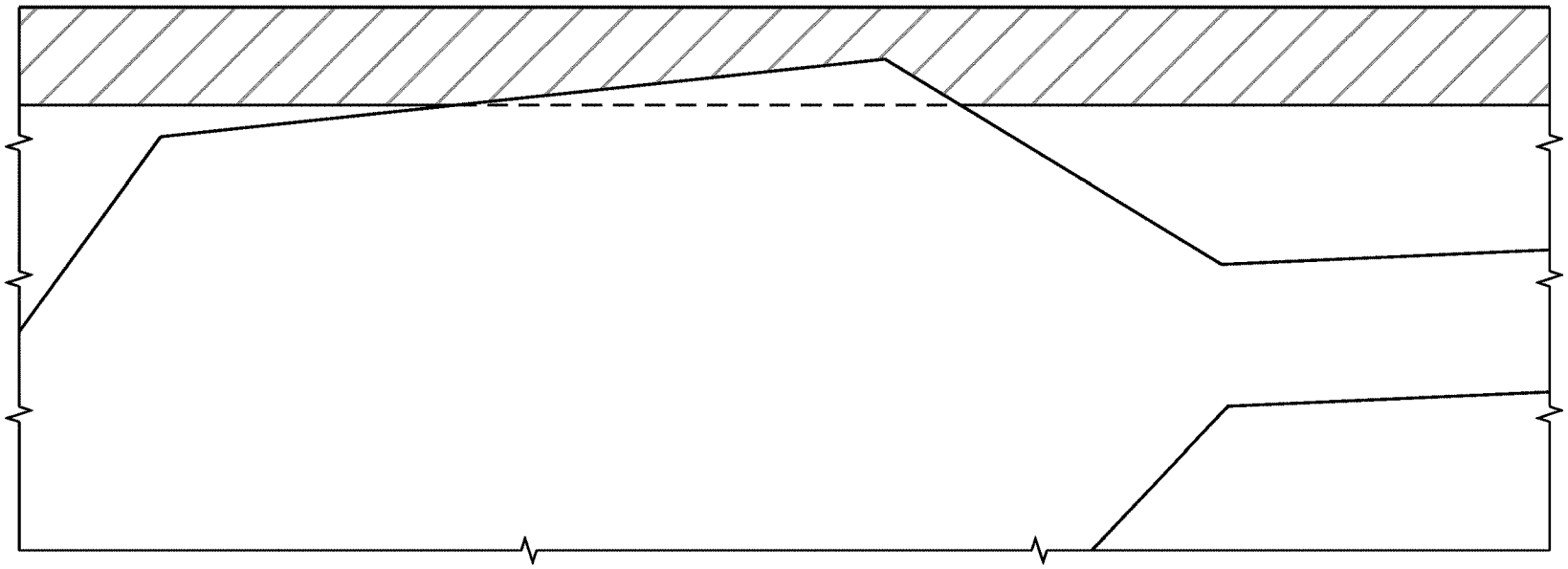
(PRIOR ART) FIG. 1
FIG. 1 is a section view of a prior art lower mill that is coupled to a window mill that has a full diameter section to reduce wear.
Figure 2:
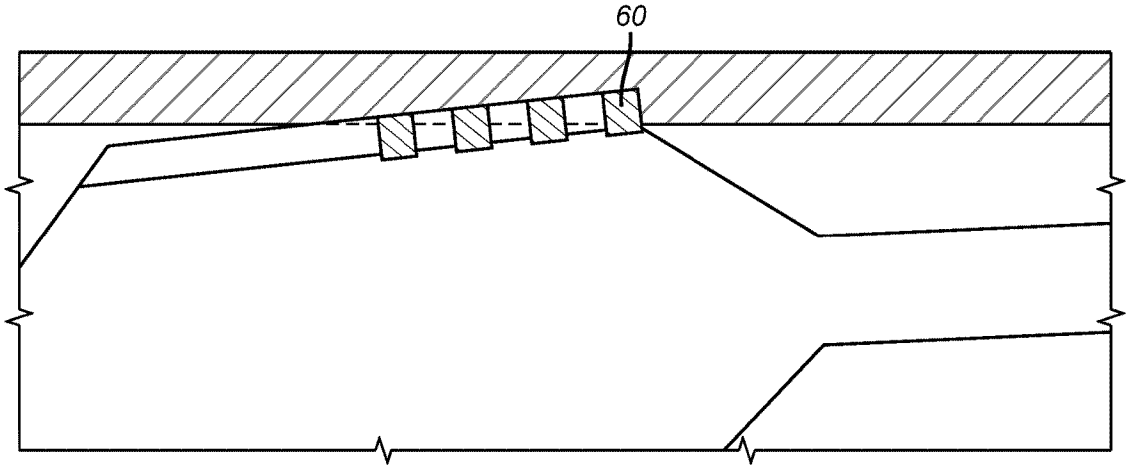
FIG. 2 shows a section view of the lower mill of the present invention beginning to make a cut.
Figure 3:
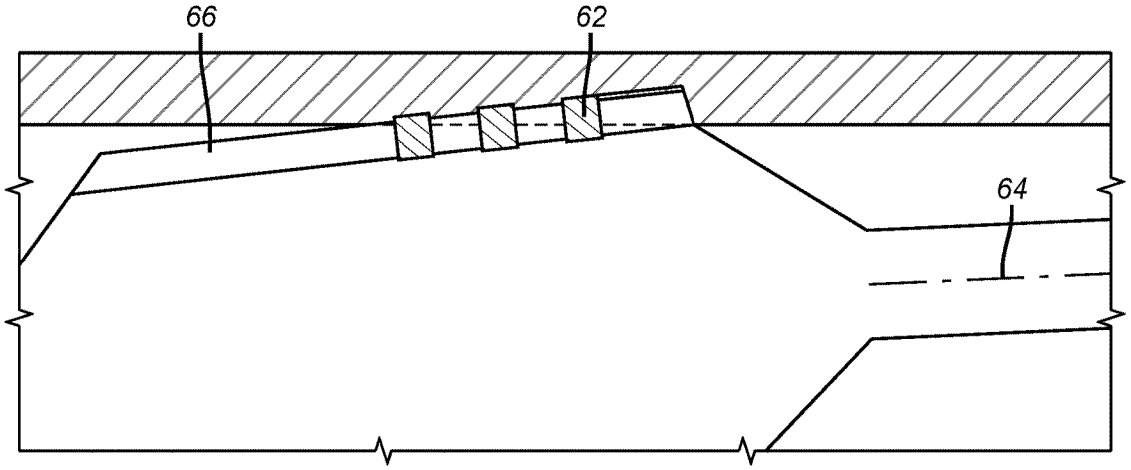
FIG. 3 is the view of FIG. 2 after initial cutting was worn away the initial row of inserts to let the next row assume a cutting position to continue removal of the casing wall when extending the window.
Figure 4:
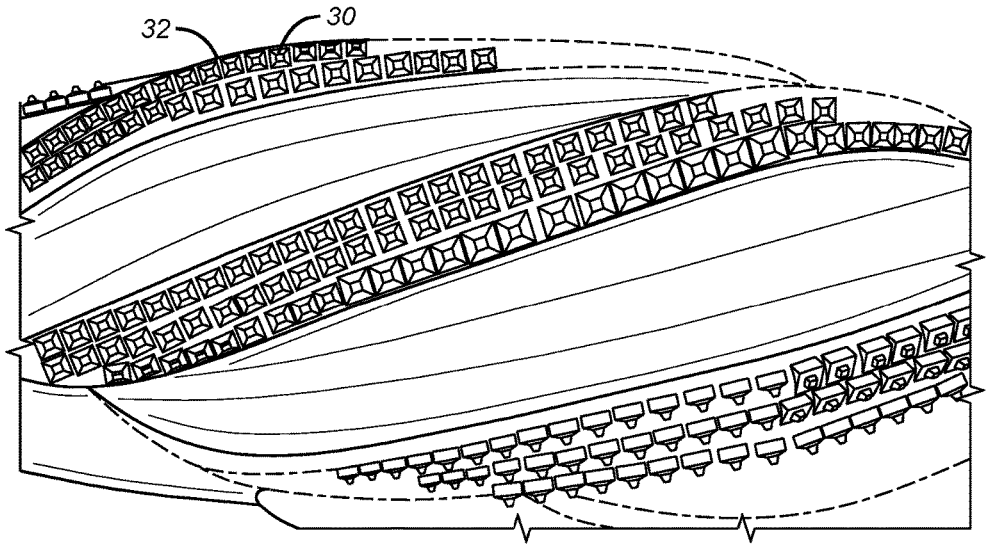
(PRIOR ART) FIG. 4
FIG. 4 shows a prior art lower mill with densely packed inserts on the blades.
Figure 5:
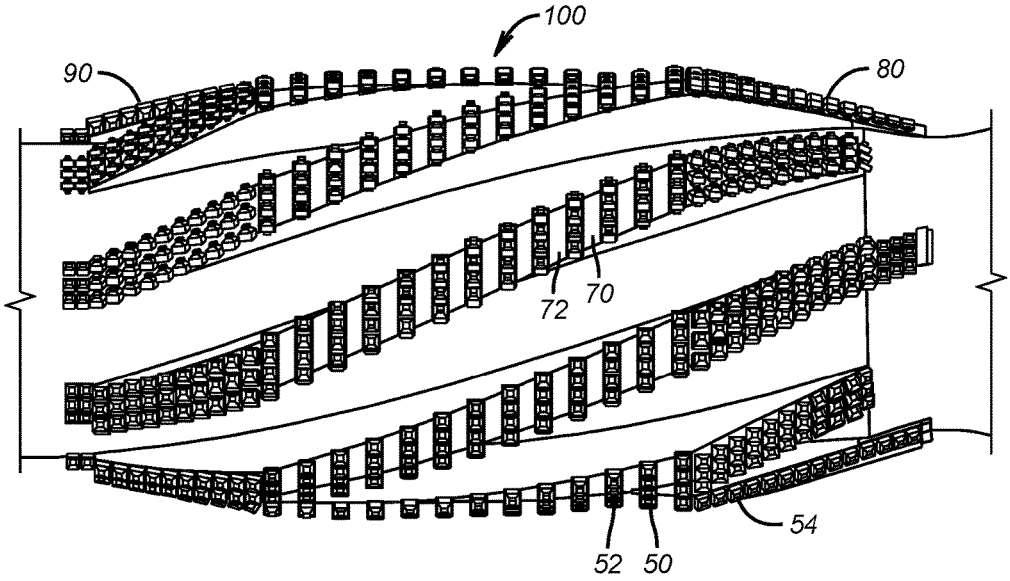
FIG. 5 shows the lower mill of the present invention with spaced rows of inserts on a cylindrically shaped outside surface.

Comparing FIGS. 4 and 5 it can be seen that the prior design of FIG. 4 added inserts 30 to the blade faces 32 in a very densely packed manner with the idea of putting as much cutting structure at these locations as possible. What this accomplished however was very low contact stress and far less cutting of the wall of the tubular. Instead the inserts simply wore down a part of the inside surface of the tubular wall without actually accomplishing the intended result of extending the window to the region near the top of the whipstock. FIGS. 2, 3 and 5 illustrate that the solution to the inability of the lower mill of the FIG. 4 design to cut an extension of the window is to use fewer inserts in rows such as 50 and 52 that are axially spaced at a distance such that when the lower mill is tracking on the whipstock ramp the cutters or inserts 54 in row 50 are first to cut into the inside wall of the casing. As a result of only one row cutting initially, the stress in the inserts 54 is heightened. When this factor is combined with the use of very durable and sharp inserts such as those that are described in US 20120073880 in FIG. 8 or in application Ser. No. 13/487,844 and Ser. No. 12/700,845 whose teachings and content are fully incorporated herein as if fully set forth the result is far more effective wall penetration and the desired lengthening of the window. These cutters which can be tungsten carbide or a polycrystalline diamond material have a square or rectangular base and shapes extending from opposed ends generally in the form of a truncated pyramid to define a plurality of cutting surfaces. As seen in FIGS. 2 and 3 when the lead cutters in row 60 break away or wear the next row behind 62 has its cutters come into position of cutting more of the wall in the same location and to a greater extend. The whipstock inclination angle inclines the axis 64 to the same angle so that the outer surface defined by the blades 66 defines a straight cylinder shape with an incline such that at some point there is overlap in cutting by a lead row and the row of inserts that are behind in the next row. The fact that due to the spacing between adjacent breaks such as 70 and 72 the contact stress is increased over dense insert packing. The sharpness of the inserts coupled with a focus on fewer inserts doing the cutting promotes greater penetration into the wall and ultimately extension of the window. Ideally by the time a leading row penetrates about half its insert depth into the casing wall the row just behind starts cutting. With the blade edges defining a straight cylinder shape and with the whipstock angle being known the geometry of the inserts can be configured for enhancement of the cutting action to an increase in contact stress coupled with cutting inserts that have multifaceted cutting edges. The rows can be preferably perpendicular to the lower mill axis and can be equally spaced. The row of inserts at the blade end at any axial location can be in aligned segments that are circumferentially spaced at the outermost portions of each blade. A leading and trailing tapers that have closely packed inserts 80 and 90 respectively facilitate advance and removal of the window mill on initiation of rotation and on removal. While the profile of the middle section 100 is illustrated as preferably cylindrical it can have other shapes including slightly arcuate or tapered such that as the cutting progresses the contact stress can be varied by having additional cutters engaging at the same time as compared to when the initial cutting occurs with the lower mill. The lower mill can be at the drift dimension of the surrounding tubular or a smaller dimension preferably for the larger sized tubulars of 7 inches or more.

Figure 7:
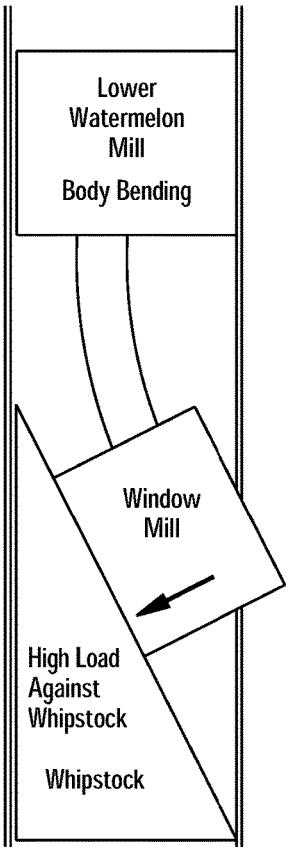
FIG. 7 illustrates the onset of bending stress near the lower mill as the window mill starts the window.
Figure 8:
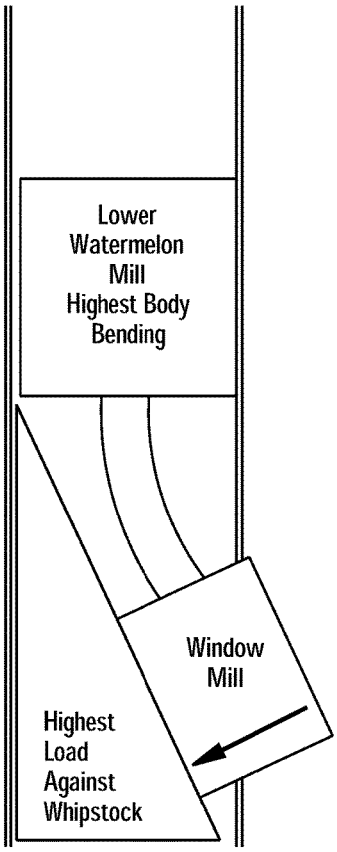
FIG. 8 is the view of FIG. 7 showing the heightened stress near the lower mill as the window mill makes an exit through the casing.
Figure 9:
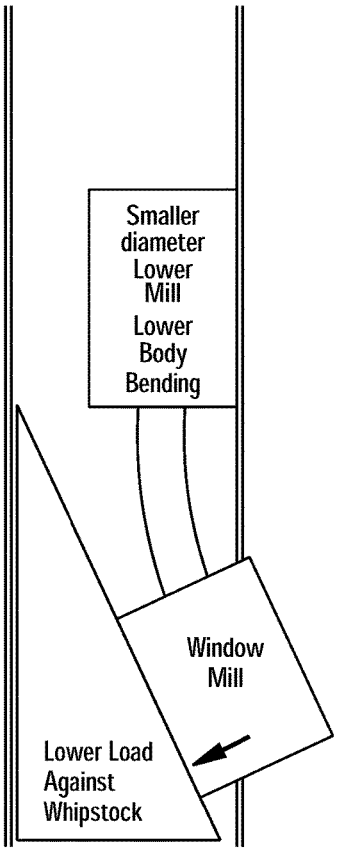
FIG. 9 illustrates how the use of a smaller diameter lower mill reduces the bending stress at the lower end of the lower mill.

FIGS. 7-9 graphically illustrate how the bending stress near the lower mill builds up and reaches its highest point when the window mill exits to its half-way point through the casing wall. Reducing the lower mill dimension as compared to the drift dimension also helps to diminish the retaining force acting on the window mill to retain it against the whipstock after half of the window mill exits the casing as well as lowering the bending stress at the lower mill by a corresponding degree.

The above description is illustrative of the preferred embodiment and many modifications may be made by those skilled in the art without departing from the invention whose scope is to be determined from the literal and equivalent scope of the claims below:

We claim:

1. A method for making a tubular exit at a subterranean location, comprising:

supporting a whipstock in the tubular;

rotatably mounting a window mill having a longitudinal axis to a delivery string;

advancing said window mill on a ramp of said whipstock to initiate the forming of a window;

connecting a lower mill to said window mill by a mandrel having an outside dimension smaller than a peripheral surface of a plurality of blades on said lower mill for tandem movement therewith with respect to said whipstock, said blades extending generally in in the direction of a longitudinal axis of said lower mill, with said outer peripheral surface of at least one of said blades further comprising more than two axially spaced rows of cutters with said rows comprising multiple cutters oriented substantially perpendicularly to said longitudinal axis of said lower mill with said rows extending in circumferential alignment among said plurality of blades.

2. The method of claim 1, comprising:

orienting said rows perpendicularly to said axis.

3. The method of claim 2, comprising:

spacing said rows equally or unequally.

4. The method of claim 3, comprising:

forming said peripheral surface to define a cylinder shape.

5. The method of claim 4, comprising:

overlapping said cutters in one row while cutting with said cutters from an adjacent said row for tandem cutting as said cutters from said one row wear.

6. The method of claim 5, comprising:

positioning said whipstock axis in a manner that said cutters from a row, not initially cutting the tubular, advance into the tubular as cutters from another row are wearing from cutting the tubular.

7. The method of claim 6, comprising:

configuring only one or two rows of said cutters cut the tubular at a given time.

8. The method of claim 7, comprising:

providing said cutters of tungsten carbide or a polycrystalline diamond material with a square or rectangular base; and forming shapes extending from opposed ends of said base generally in a truncated pyramid to define a plurality of cutting surfaces.

9. The method of claim 4, comprising:

extending said cutters up to a drift dimension of the tubular.

10. The method of claim 1, comprising:

spacing said rows equally or unequally.

11. The method of claim 1, comprising:

forming said peripheral surface to define a cylinder shape.

12. The method of claim 11, comprising:

extending said cutters up to a drift dimension of the tubular.

13. The method of claim 1, comprising:

overlapping said cutters in one row while cutting with said cutters from an adjacent said row for tandem cutting as said cutters from said one row wear.

14. The method of claim 1, comprising:

positioning said whipstock axis in a manner that said cutters from a row, not initially cutting the tubular, advance into the tubular as cutters from another row are wearing from cutting the tubular.

15. The method of claim 1, comprising:

configuring only one or two rows of said cutters cut the tubular at a given time.

16. The method of claim 1, comprising:

shaping said peripheral surface as tapered or arcuate.

17. The method of claim 1, comprising:

providing said cutters of tungsten carbide or a polycrystalline diamond material with a square or rectangular base; and forming shapes extending from opposed ends of said base generally in a truncated pyramid to define a plurality of cutting surfaces.

18. A method for making a tubular exit at a subterranean location, comprising:

supporting a whipstock in the tubular;

rotatably mounting a window mill having a longitudinal axis to a delivery string;

advancing said window mill on a ramp of said whipstock to initiate the forming of a window;

connecting a lower mill to said window mill by a mandrel having an outside dimension smaller than a peripheral surface of a plurality of blades on said lower mill for tandem movement therewith with respect to said whipstock, said blades extending generally in in the direction of a longitudinal axis of said lower mill, with said outer peripheral surfaces of said blades further comprising more than two axially spaced rows of cutters with said rows comprising multiple cutters oriented substantially perpendicularly to said longitudinal axis of said lower mill with said rows extending in circumferential alignment among said plurality of blades;

forming said peripheral surface to define a cylindrical shape;

flanking said cylindrical shape by tapered surfaces and cutters arranged in closely spaced rows without gaps between said closely spaced rows.

19. A method for making a tubular exit at a subterranean location, comprising:

supporting a whipstock in the tubular;

rotatably mounting a window mill having a longitudinal axis to a delivery string;

advancing said window mill on a ramp of said whipstock to initiate the forming of a window;

connecting a lower mill to said window mill by a mandrel having an outside dimension smaller than a peripheral surface of a plurality of blades on said lower mill for tandem movement therewith with respect to said whipstock, said blades extending generally in in the direction of a longitudinal axis of said lower mill, with said outer peripheral surfaces of said blades further comprising more than two axially spaced rows of cutters with said rows comprising multiple cutters oriented substantially perpendicularly to said longitudinal axis of said lower mill with said rows extending in circumferential alignment among said plurality of blades;

orienting said rows perpendicularly to said axis;

spacing said rows equally or unequally;

forming said peripheral surface to define a cylindrical shape;

flanking said cylindrical shape by tapered surfaces and cutters arranged in closely spaced rows without gaps between said closely spaced rows.

* * * * *